United States Patent [19]

Tisbo et al.

[11] 4,357,000

[45] Nov. 2, 1982

[54] MOLDED PLASTIC FENCE SECTION

[75] Inventors: Cosmo N. Tisbo; Thomas A. Tisbo, both of Barrington, Ill.

[73] Assignee: Custom Plastics, Inc., Elk Grove Village, Ill.

[21] Appl. No.: 202,781

[22] Filed: Oct. 31, 1980

[51] Int. Cl.[3] ..... E04H 17/14; E04H 17/18

[52] U.S. Cl. ..... 256/26; 256/19; 256/22; 256/24; D25/42

[58] Field of Search ..... 256/26, 25, 24, 19, 256/22; 16/260, 259; D25/42

[56] References Cited

U.S. PATENT DOCUMENTS

| | | | |
|---|---|---|---|
| D. 188,112 | 6/1960 | Winograd et al. | 256/19 X |
| 2,628,823 | 2/1953 | Rhome et al. | 256/26 |
| 2,685,432 | 8/1954 | Murray, Jr. | 256/22 |
| 3,484,081 | 12/1969 | Rowan | 256/22 |
| 3,711,066 | 1/1973 | Niemiec | 256/19 |
| 4,130,272 | 12/1978 | Emmie | 256/26 X |

FOREIGN PATENT DOCUMENTS

| | | | |
|---|---|---|---|
| 1281474 | 10/1968 | Fed. Rep. of Germany | 256/24 |

*Primary Examiner*—James Kee Chi
*Attorney, Agent, or Firm*—Anthony S. Zummer

[57] ABSTRACT

The present invention relates to an improved ornamental integrally molded plastic fence section. The fence section generally includes a pair of substantially parallel stringers with a plurality of pickets formed integral with the stringers. Said pickets being oriented substantially perpendicular to the stringers. Each stringer has a plurality of identical spaced ears formed integral with one end. Each of the ears has a rod aperture extending therethrough. The rod apertures in the ears on one end of a stringer are aligned with rod apertures in ears on the other stringer. A slot is formed in each ear extending from the exterior of the respective ear to the respective aperture. Each slot in each ear on one end of the section is aligned with the other slots in the other ears on that end of the section. A second plurality of supports is formed integral with the other end of each of the stringers. Each of the supports has a height less than the distance between adjacent ears in the first mentioned plurality. Each of the supports has a width less than the width of the slots in the ears. A cylindrical rod is formed integral with the supports on the end of the stringer. Each rod has a diameter slightly less than the diameter of the rod aperture to fit snugly into the respective aligned rod apertures in the ears. The cylindrical rods fit into the ears and the supports pass through the slots to lock adjacent sections to each other by rotating the section relative to each other after each rod has been positioned in its respective rod apertures.

12 Claims, 6 Drawing Figures

FIG. 1
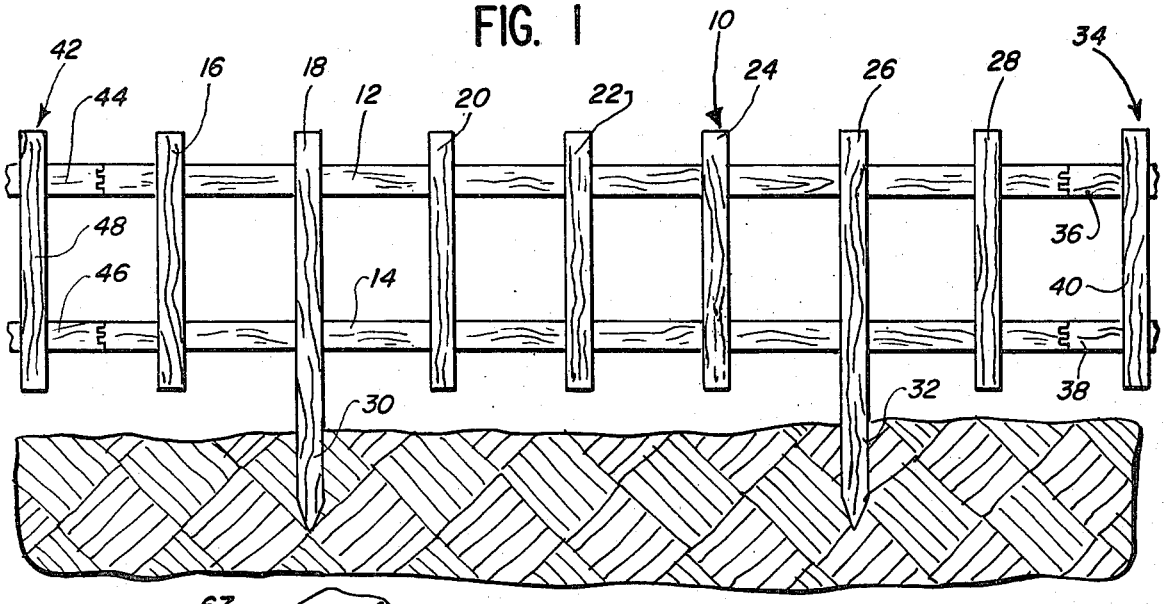
FIG. 2
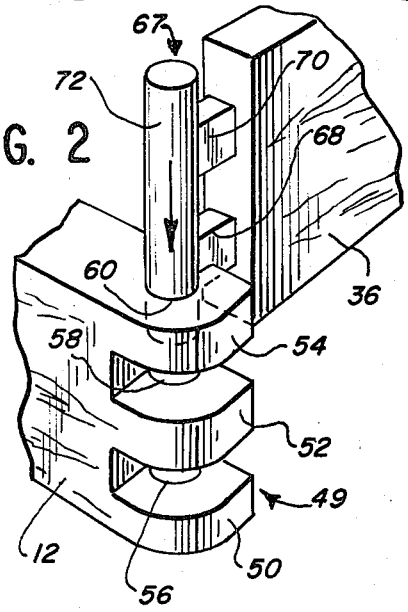
FIG. 3
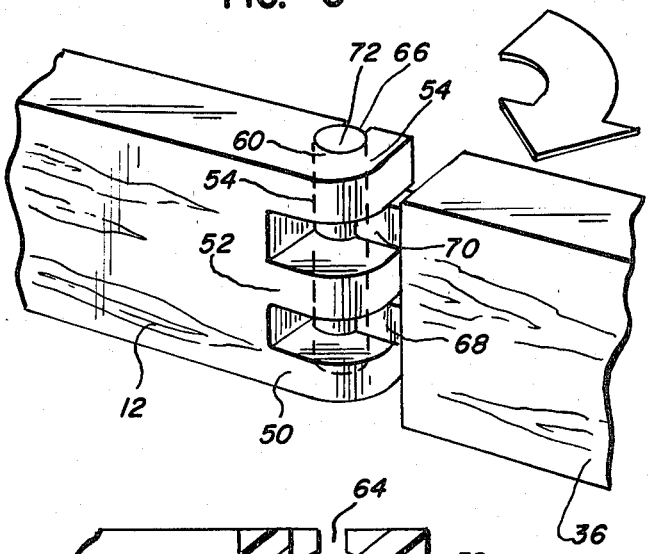
FIG. 4
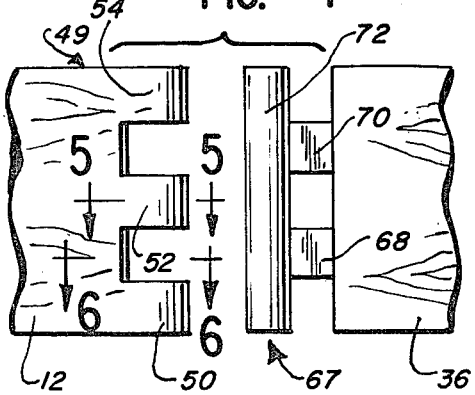
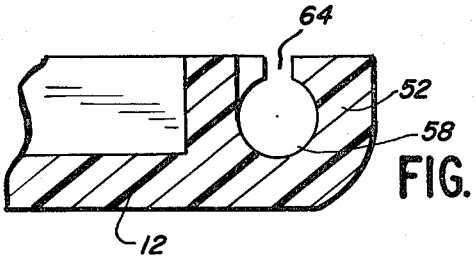
FIG. 5
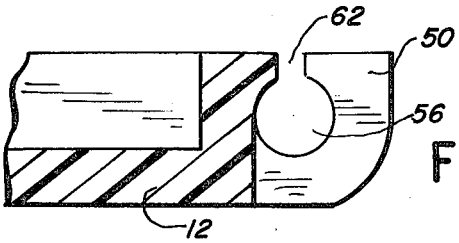
FIG. 6

MOLDED PLASTIC FENCE SECTION

BACKGROUND OF THE INVENTION

Gardeners, in many instances, find that it is desirable to retain certain plants in a given area. For instance, when a flower bed abuts a lawn and the flowers are tall, it is often necessary to place a fence at the edge of the flower bed to prevent the flowers from falling onto the lawn. The utilization of a fence enhances the appearance by making the flower bed neat. Many types of fences have been used with flower beds. A common type of fence is a short wire fence. In certain instances, a short wooden fence is used in which the wooden fence is painted. It is recognized that wooden fences and wire fences have a tendency to deteriorate, wire by corrosion and wood by decay. It is recognized that it is desirable to provide a plastic fence section which does not require any substantially maintenance in view of the fact that a plastic fence retains its color and does not easily deteriorate. In order to provide an economical plastic fence, it is found that a plastic fence which is made up in sections is desirable. Sectional fences may be easily handed and picked up and stored readily. In addition, by making the fence in sections, it is convenient to place the sections in substantial conformity to the outline of a flower bed or other growing area. Plastic fences in sections are known for use in gardens. In order to maintain the sections upright and to provide continuity, it is desirable to provide locks at the end of each section so that adjacent sections may be interlocked.

An interlocking plastic fence section is shown in the U.S. Pat. No. 3,711,066, issued Jan. 16, 1973, to Lee P. Niemiec. The Niemiec fence section construction relies upon the resilience of the plastic parts in order to lock one section to another. The parts are made to a close tolerance wherein a male member snaps into a female member to be held therein. In addition to requiring very close tolerance in the manufacture of the parts, it is to be recognized that these sections ae ordinarily placed in the garden where they are exposed to strong sunlight and to weathering. The continued exposure to strong sunlight and weathering tends to make the plastic parts brittle so that the insertion or removal of one part from another may cause a part to break and thereby become inoperative for holding the sections together. It is recognized that ordinarily the sections are placed into position in the spring when the weather is relatively cool and are usually removed after a frost when the weather is also quite cool, so that the aging plus the low temperatures tend to make the parts brittle and thereby subject to damage. It is a principle object of this invention to provide an improved fence section construction wherein the sections are locked to each other without depending upon resilience of plastic parts.

SUMMARY OF THE INVENTION

The present invention relates to an improved ornamental molded plastic fence section which is formed as a single unitary part. Each section is capable of being locked to a adjacent identical section to make up a continuous fence. Each fence section includes a pair of substantially parallel stringers. A plurality of pickets is formed integral with the stringers. The pickets are substantially perpendicular to the stringers and are adapted to be substantially perpendicular to the earth when the sections are interconnected and placed into the earth.

One end of each of the stringers has a plurality of identical spaced ears formed integral with that end. Each of the ears has a rod aperture ending therethrough. The rod apertures on one end of a stringer are aligned on a single centerline. A slot is formed in each ear. Each slot extends from the exterior of the ear to the respective rod aperture in the ear. Each slot in each ear is aligned with the slots in the other ears on the respective end of the stringer.

A second plurality of supports is formed integral with the other end of each of the stringers. Each support has a height less than the distance between adjacent ears in the first mentioned plurality. Each of the supports has a width less than the width of each of the slots in each of the ears. A cylindrical rod is formed integral with the supports on the end of the stringer. Each rod has a diameter slightly less than the diameter of the rod aperture for snugly fitting into aligned rod apertures in a given plurality of ears. The cylindrical rods on the ends of the stringers are placed into the rod apertures in the ears of an adjacent fence section and the sections are moved vertically relative to each other to allow the supports to pass through slots in the ears. The sections are then rotated to position the supports between each and thereby lock the adjacent sections to each other.

BRIEF DESCRIPTION OF THE DRAWINGS

FIG. 1 is a side elevational view of a fence section embodying the herein disclosed invention showing its opposite ends connected to adjacent identical fence sections;

FIG. 2 is a perspective view showing an enlarged end of portions of stringers of adjacent fence sections embodying the herein disclosed invention showing a rod in an attitude for insertion into rod apertures in a plurality of ears;

FIG. 3 is an enlarged perspective view showing the adjacent stringers of FIG. 2 locked to each other;

FIG. 4 is a side elevational view showing the end of one stringer of FIG. 2 with a plurality of ears and the opposite end of another stringer of FIG. 2 with a pair of supports and a rod formed integral therewith;

FIG. 5 is a cross-sectional view taken on line 5—5 of FIG. 4 and;

FIG. 6 is a cross-sectional view taken on line 6—6 of FIG. 4.

DESCRIPTION OF THE PREFERRED EMBODIMENT

Referring now to the drawings and especially to FIG. 1, an ornamental fence section, embodying the herein disclosed invention, is shown therein and is generally indicated by numeral 10. Fence section 10 is a single unitary part, which is molded of a suitable plastic material, such as, polyethylene. Section 10 generally includes a pair of parallel stringers 12 and 14. Pickets 16, 18, 20, 22, 24, 26 and 28 are formed integral with the stringers and are oriented perpendicular to the stringers. Pickets 18 and 26 have stakes, 30 and 32 respectively formed integral with the lower end of the pickets. Each of the stakes 30 and 32 has its lowermost position pointed to facilitate insertion of the stakes into earth.

Fence section 10 is locked to a second fence section 34, which is identical in construction to fence section 10. Fence section 34 includes a pair of parallel stringers 36 and 38 which are partially shown in FIG. 1. Fence section 34 also includes a picket 40, which is identical to picket 16 of section 10. A third fence section 42 is connected to the other end of section 10. Section 42 is identical in construction to section 10 and includes a pair of parallel stringers 44 and 46 with a picket 48 formed integral therewith. Picket 48 is identical to picket 28 of section 10.

Looking now to FIG. 2, an enlarged perspective view is shown of the ends of stringers 12 and 36. The end of stringer 12 has a female receptacle 49 found integral therewith. Female receptacle 49 includes three identical ears 50, 52, 53 formed integral with the end of the stringer. Ears 50, 52, 54 extend along the length of the stringer and are parallel to each other. Rod apertures 56, 58 and 60 are formed in ears 50, 52, and 54 respectively. Rod apertures 56, 58 and 60 have the same diameter, and the rod apertures are aligned so that they have a common centerline. A slot 62 is formed in ear 50 and opens into rod aperture 56. A slot 64, identical to slot 62, is formed in ear 54 opening into rod aperture 60. Slot 66 is identical to slots 62 and 74 and is aligned with slots 62 and 64. Slots 62, 64 and 66 are perpendicular to the length of stringer 12.

The end of stringer 36 adjacent to stringer 12 includes an integral male latch 67 which is mateable with female receptacle 49. Male latch 67 includes a pair of supports 68 and 70. Supports 68 and 70 are formed integral with the end of stringer 36 and extend axially along the length of the stringer. Each of the supports 68 and 70 has a width slightly less than the width of slots 62, 64 and 66. The height of each of the supports 68 and 70 is slightly less than the distance between adjacent ears 50 and 52 and ears 52 and 54. A cylindrical rod 72 is formed integral with supports 68 and 70 in an attitude substantially parallel to the end of stringer 36 as may be seen in FIG. 2. The diameter of rod 72 is slightly less than the diameter of the rod aperture in the ears so that the rod fits snugly into the rod aperture.

Each fence section includes a pair of identical and aligned female receptacles on one end. The end of stringer 14 adjacent to stringer 38 is identical to the end of stringer 12 adjacent to stringer 36 as described above. The ends of stringers 44 and 46 adjacent to section 10 are also identical to the end of stringer 12 adjacent stringer 36 as described above.

Each fence section includes a pair of identical aligned male latches on the other end opposite the female receptacle. The end of stringer 38 adjacent to stringer 14 is identical to the end of stringer 36 adjacent to stringer 12 as described above. In addition, the ends of stringer 12 and 14 adjacent to stringers 44 and 46, respectively, are identical in construction to the end of stringer 36 adjacent to stringer 12 as described in detail above.

Each integral ornamental molded plastic fence section is identical in construction to each other fence section. In order to connect the fence sections, it is necessary to place the fence sections at right angles to each other as shown in part in FIG. 2. Rod 72 is positioned in rod aperture 60 and the sections are moved vertically relative to each other, so that, supports 68, 70 pass through the slots in the ears. Support 68 is positioned between ears 50 and 52, and support 70 is positioned between ears 52 and 54. The fence sections are then rotated relative to each other and may be pivotted to an attitude wherein the sections are in line as shown in part in FIG. 3. It may be readily appreciated that once the rod is positioned in the rod aperture and the fence section is rotated, the sections are secured to each other. The sections may be easily separated simply by pivotting the sections to an attitude wherein the sections are perpendicular to each other and the sections are then removed vertically relative to each other so that the supports may pass through the slots and thereby disengage the sections from each other.

It may be readily appreciated that once the sections are locked to each other, the stakes 30 and 32 may be pushed into the earth to hold the sections upright relative to the earth. The sections are securely locked to each other and will not easily disengage each other. Inasmuch as the sections are securely locked to each other by the interaction of the male latches and the female latches in the receptacle, they will not come apart upon being struck or otherwise sharply moved. Accordingly, the fence has a high degree of stability. Since the sections are made of a single integrally molded plastic part, it is evident that the sections may be made economically and have a high resistance to weathering. Furthermore, the subject interlocking arrangement does not depend upon a maintenance of the resilence of the parts so that aging and weathering has virtually no effect on the operation of the subject fence sections.

Although a specific embodiment of the herein disclosed invention has been shown in the accompanying drawing and described in detail above, it is readily apparent that those skilled in the art may make various modifications and changes in the disclosed construction without departing from the spirit and scope of this invention. It is to be expressly understood that the instant invention is limited only by the appended Claims.

What is claimed is:

1. An ornamental integrally molded plastic fence section comprising: a pair of substantially parallel stringers, a plurality of pickets, each of said pickets being substantially perpendicular to the stringers and being formed integral with the stringers, a plurality of identical spaced ears formed integral with one end of each stringer, each of said ears have a rod aperture extending therethrough and being aligned with the rod aperture of each other ear of the plurality, selected ears having slots contained therein, each slot extending from the exterior of the respective ear to the respective rod aperture, each slot in each ear being aligned with each slot in each other ear in the respective plurality, a second plurality of supports formed integral with the other end of each of the stringers, each of said supports having a height less than the distance between adjacent ears in the first mentioned plurality, each of the supports having a width less than the width of the slot in the ears, and a cylindrical rod formed integral with the supports in a given plurality, each of said rods having a diameter slightly less than the diameter of each rod aperture for snugly fitting into aligned rod apertures in a given plurality of ears, whereby adjacent fence sections are readily locked to each other by inserting each rod of one section into rod apertures of a second section with the sections positioned in an attitude wherein the supports pass through the slots, and pivotting of the sections relative to each other positions the supports between adjacent ears.

2. An ornamental integrally molded plastic fence as defined in claim 1, wherein the slots in the ears are perpendicular to the stringers.

3. An ornamental integrally molded plastic fence section as defined in claim 1 including, a stake formed integral with each of a pair of pickets, each stake having its end pointed for insertion into the earth for holding the fence section upright.

4. An ornamental integrally molded plastic fence section as defined in claim 1 wherein the number of ears in each plurality is one more than the number of supports in each second plurality.

5. An ornamental integrally molded plastic fence section as defined in claim 1 including, a stake formed integral with each of a pair of pickets, each stake being pointed for insertion into earth to hold the fence section upright, and the slots are substantially perpendicular to the stringers.

6. An ornamental integrally molded plastic fence section as defined in claim 1, wherein the slots are substantially perpendicular to the length of the respective stringer, and the number of ears in the plurality is one greater than the number of supports in the second plurality.

7. An ornamental integrally molded plastic fence section as defined in claim 1 including, a stake formed integral with each of a pair of pickets, each stake being pointed for insertion into earth to hold the fence substantially upright and the number of ears in the plurality is one greater than the number of supports in the second plurality.

8. An ornamental integrally molded plastic fence section as defined in claim 1 including, a stake formed integral with each of a pair of pickets, each stake being pointed for insertion into earth to hold the fence section substantially upright, the slots in a plurality of ears being substantially perpendicular to the respective stringer, and the number of ears in the plurality of identical spaced ears is one greater than the number of supports in the second plurality.

9. An ornamental integrally molded plastic fence section comprising: a pair of substantially parallel stringers, a plurality of pickets, each of said pickets being substantially perpendicular to the stringers and being formed integral with the stringers, an identical ear formed integral with one end of each stringer, said ear has a rod aperture extending therethrough, a slot formed in each ear, each slot extending from the exterior of the respective ear to the rod aperture, a plurality of supports formed integral with the other end of each of the stringers, one of the supports of each plurality having a width less than the width of the slot in each of the ears, and cylindrical rod formed integral with the supports in a given plurality, each of said rods having a diameter slightly less than the diameter of the rod aperture for snugly fitting into the rod aperture, whereby adjacent fence sections are readily locked to each other by inserting each rod of one section into a respective rod aperture of a second section with the sections positioned in an attitude allowing the supports to pass through the respective slots, and then pivotting of the sections relative to each other to lock the sections to each other.

10. In an ornamental integrally molded plastic fence section for use in a garden, the fence section having locking means for securing the fence section to an adjacent identical fence section, the improvement comprising, locking means including a pair of ears formed as an integral part of one end of the fence section, one of said ears has a rod aperture extending therethrough, a slot formed in the ear having a rod aperture, said slot extending from the exterior of the ear to the rod aperture; and the locking means including a latch formed as an integral part of the other end of the fence section, the latch including a support formed integral with the other end of the fence section, the support having a width less than the width of the slot in the ear, and a cylindrical rod formed integral with the support, said rod having a diameter slightly less than the diameter of the rod aperture for snugly fitting into the rod aperture, whereby adjacent fence sections are readily locked to each other by inserting the rod of one section into the rod aperture of a second section with the sections positioned in an attitude wherein the support passes through the slot, and pivotting of the sections relative to each other positions the support adjacent to the ear.

11. In an ornamental integrally molded plastic fence section for use in a garden, the fence section having an integral locking means for securing the fence section to an adjacent identical fence section, the improvement comprising, locking means including a pair of female receptacles formed integral therewith, each female receptacle including an ear, each ear having a rod aperture extending therethrough and being aligned with the rod aperture of the ear in the other female receptacle, a slot formed in each ear in each female receptacle, each slot extending from the exterior of the respective ear to the rod aperture; and said locking means including a pair of male latches formed integral therewith, each of said latches including a support, each support having a width less than the width of the slot in the ears, and a cylindrical rod formed integral with the support in each latch, each of said rods having a diameter slightly less than the diameter of the rod aperture in the ear for snugly fitting into an aligned rod aperture in a selected female receptacle, whereby adjacent fence sections are locked to each other by inserting each rod of one section into a rod aperture of a second section with the sections in an attitude whereby the support passes through the respective slot, and pivotting of the sections relative to each other positions the supports adjacent to respective ears.

12. In an ornamental integrally molded plastic fence section for use in a garden, said fence section having integral locking means for securing the fence section to an adjacent identical fence section, the improvement comprising, locking means including a pair of female receptacles formed as an integral part of one end of the fence section, each female receptacle including a pair of identical spaced ears formed as an integral part of the fence section, each of said ears having a rod aperture extending therethrough and being aligned with the rod aperture of the other ear of the female receptacle, a slot formed in an ear in each female receptacle, each slot extending from the exterior of the respective ear to the respective rod aperture; and said locking means including a pair of male latches formed as an integral part of the opposite end of the fence section, each of said latches including a support, each support having a height less than the distance between adjacent ears, each of the supports having a width less than the width of the slot in the ears, and a cylindrical rod formed integral with the support in each latch, each of said rods having a diameter slightly less than the diameter of the rod aperture for snugly fitting into an aligned rod aperture in a selected female receptacle, whereby adjacent fence sections are locked to each other by inserting each rod of one section into a rod aperture of a second section with the sections positioned in an attitude whereby the supports pass through respective slots, and pivotting of the sections relative to each other positions the supports between adjacent ears.

* * * * *

UNITED STATES PATENT OFFICE

CERTIFICATE OF CORRECTION

PATENT NO. : 4,357,000

DATED : November 2, 1982

INVENTOR(S) : Cosmo N. Tisbo, and Thomas A. Tisbo

It is certified that error appears in the above-identified patent and that said Letters Patent are hereby corrected as shown below:

Col. 1, line 41, "ae" should be --are--

Col. 3, line 58, "68,70" should be --68 and 70--

Signed and Sealed this

*Twenty-eighth* Day of *December 1982*

[SEAL]

*Attest:*

GERALD J. MOSSINGHOFF

*Attesting Officer*

*Commissioner of Patents and Trademarks*